US005487796A

United States Patent [19]

Soraya

[11] Patent Number: 5,487,796

[45] Date of Patent: Jan. 30, 1996

[54] METHOD OF QUENCHING METALS

[76] Inventor: Sorayapour Soraya,
Kurt-Schumacher-Allee 84, 66740
Saarlouis, Germany

[21] Appl. No.: 417,377

[22] Filed: Apr. 5, 1995

[30] Foreign Application Priority Data

Nov. 15, 1994 [DE] Germany ..... 44 40 777.7

[51] Int. Cl.[6] ..... C21D 1/60

[52] U.S. Cl. ..... 148/633; 148/637

[58] Field of Search ..... 148/637, 633

[56] References Cited

U.S. PATENT DOCUMENTS 3,963,535 6/1976 Lineberg ..... 148/637

*Primary Examiner*—Sam Silverberg

*Attorney, Agent, or Firm*—Henry M. Feiereisen

[57] ABSTRACT

A method of quenching metals, in particular steel alloys includes treatment of the article being quenched in a boiling aqueous solution of sodium tetraborate, with gas being additionally introduced into the quench bath. The supply of gas enables a continuous operation in a wide range of application and avoids the use of conventional less environmentally friendly quenching media (oils).

10 Claims, 3 Drawing Sheets

METHOD OF QUENCHING METALS

BACKGROUND OF THE INVENTION

The present invention refers to a method of quenching metals, in particular alloy steels in a boiling water-based solution of sodium tetraborate, with the sodium tetraborate content in water amounting to between 20 and 50% by weight.

German patent no. DE 29 43 065 C2 discloses a method of quenching steels and metal alloys, with a water-based solution containing 22 to 50% by weight of sodium tetraborate and with the quenching process taking place at boiling temperature of the solution. The objective of this known method is the elimination of conventional quenching media (oil) because their use fails to address environmental standards during the quenching process and during a later disposal. Further, this known method is concerned with the control of great heat energies, e.g. in a wire rolling mill in which wire coils are quenched in rapid sequence, without necessitating a cumbersome quench bath cooling and experiencing smoke formation of the oil quenching. A drawback of this known method is the difficulty to remove solids floating in the boiling quenching medium and having a considerably higher density than water because the boiling quench bath may only be pumped at overpressure and at prevention of cooling and precipitation of sodium tetraborate crystals. Thus, the overall process and operation becomes significantly more complicated, and the maintenance costs are considerably increased.

It is generally known in connection with the quenching of metals or in the hardening technology, that it is necessary to keep the quenching medium clean. Since on the one hand solids inevitably are carried with the material being quenched into the bath and accumulate in the quench bath, and on the other hand volatile components of the quenching medium escape from the bath or components of the composition adhere to the material being quenched and exit the bath, the operation is generally carried out in such a manner that either the content of the quench bath is pumped out and disposed and then replaced by fresh quenching medium, or the losses are constantly replaced with fresh quenching medium to counter an aging of the quench bath. This procedure is however complicated and cumbersome.

SUMMARY OF THE INVENTION

It is an object of the present invention to provide an improved method of quenching metals, especially alloy steels, obviating the aforestated drawbacks.

In particular, it is an object of the present invention to provide an improved method of quenching metals which is universally usable and enables a relatively easy and continuous renewal of the quench bath for optimization of the quenching process.

These objects and others which will become apparent hereinafter are attained in accordance with the present invention by adding a gas to the solution. Preferably, the gas is injected into the solution by means of a lance assembly. Alternatively, the gas may also be blown onto the solution.

Preferably, atmospheric air is used as gas. Further examples for addition of gas include a composition of nitrogen and oxygen at an atmospheric ratio which is alternately increased and decreased. The alternating change of the partial pressures between nitrogen and oxygen amounts to a maximum of ±40%.

According to a further feature of the present invention, water vapor may be admixed to the gas.

Suitably, gas is added at a temperature which is lower by more than 45K compared to the temperature of about 101° C. of the water-based solution of sodium tetraborate.

In accordance with yet another feature of the present invention, an additional layer is formed over the surface of the quench bath which is being penetrated first by the incoming gas. This additional layer for covering the bath surface may be formed by adding a diluted solution or pure water at a temperature of 55° C. upon the quench bath, or by adding a water-based solution of sodium tetraborate at a temperature of below 60° C. upon the quench bath to form a colder and crystallized lighter sodium tetraborate solution.

By introducing a gas in the manner described above, the present invention creates a quench bath for quenching steels, in particular steel alloys, which enables a continuous operation without requiring the use of conventional quenching media (quenching oil) that adversely affect the environment during operation and disposal. Tests have surprisingly shown that the use of the conventional quench bath on the basis of a boiling aqueous solution of sodium tetraborate is usable for industrial purposes and still be environmentally acceptable when adding, in accordance with the present invention, a gas to the solution, preferably through injection.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
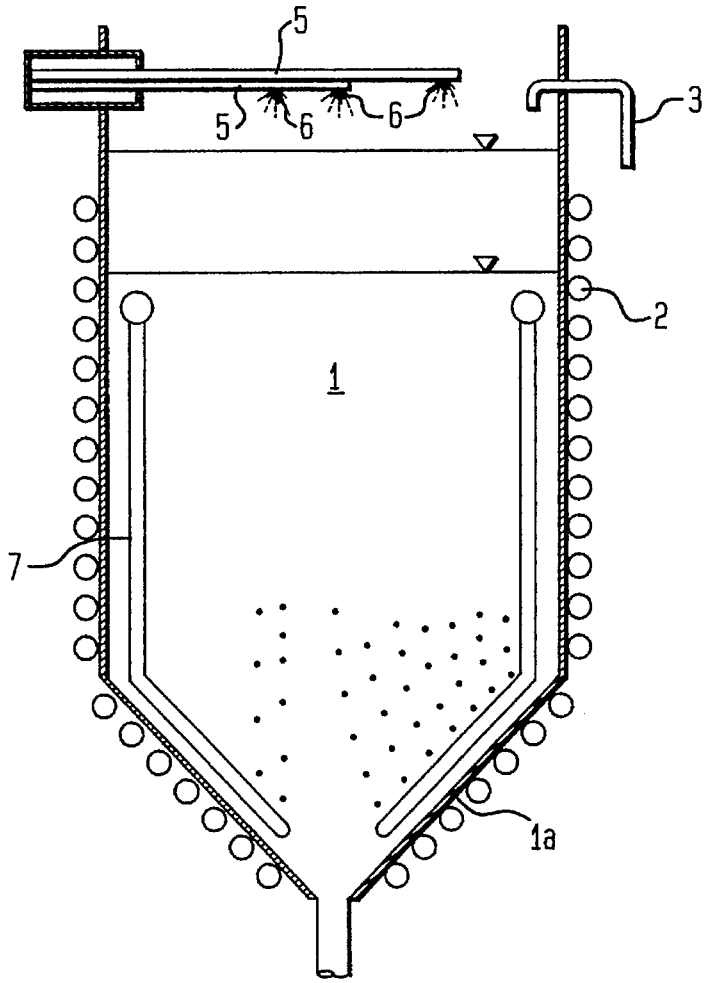
FIG. 1 a fragmentary, partly sectional view of a plant for quenching steel or alloy steel, illustrating in detail the quenching container.

Turning now to the drawing, and in particular to FIG. 1, there is shown a container 1 which is part of a plant for quenching metals, especially steels and alloy steels, and generally described in more detail in prior German patent no. DE 29 43 065, the disclosure of which is incorporated herein for sake of simplicity. The container 1 is preferably double-walled and has a tapered bottom 1*a*. A heating coil 2 surrounds the container 1 to raise the temperature of the quench bath to a desired level. Reference numeral 3 designates a supply line 3 by which fresh solution is returned to the bath as will be described furtherbelow.

Figure 2:
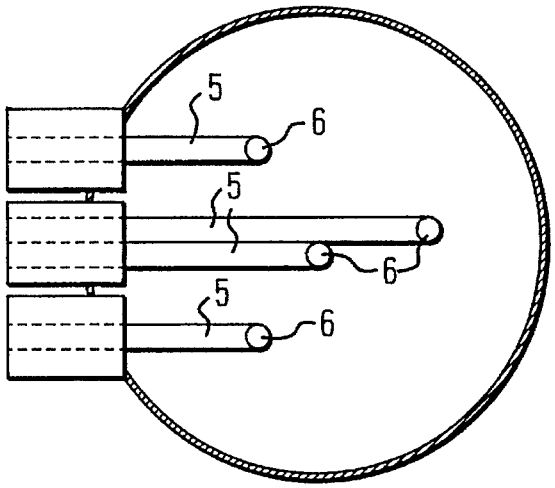
FIG. 2 is a top view of the container.

The container 1 is filled with a quenching medium in form of a water-based solution containing sodium tetraborate in a range between 20 and 50% by weight. Further entering the interior of the container 1 above the level of the quench bath is at least one lance assembly 5 which is adapted to pass through the top or side of the container 1 and has outlet nozzles 6 at its outer end to introduce a gas into the interior of the container 1. As shown in particular by the top plan view in FIG. 2, the container 1 may be provided with several lance assemblies 5 to cover a broad area over the quench bath.

The nozzles 6 may spray or inject gas onto or inject directly into the quench bath. See lance 7 in FIG. 1. Suitably, the gas is atmospheric air or a gas containing nitrogen and oxygen at an atmospheric ratio which is alternately increased and decreased. Preferably, the alternating change of the partial pressures between nitrogen and oxygen should amount to a maximum of +/−40%. It is also possible to admix water vapor to the gas.

The quantity and duration of the gas supply is dependent on the volume of the quench bath in the container 1 and the amount being quenched per time unit as well as on the quenching duration.

The temperature of gas being supplied to the quench bath is lower by more than 45K than the temperature of 101° C. of the aqueous solution of sodium tetraborate.

It will be appreciated by persons skilled in the art that the plant must contain much additional apparatus which does not appear in the foregoing Figures. For example, the lances 5 are suitably connected to a control unit for supplying the gas in a desired manner. However, this apparatus, like much other necessary apparatus, has been omitted from the Figures for the sake of simplicity.

The addition of gas in accordance with the present invention fulfills two objectives. On the one hand, components of the solution escaping during quenching and boiling are replaced by the gas (nitrogen and oxygen), while on the other hand, the gas stream in the bath is utilized to precondition the various pollutants and foreign matters, which inevitably are carried together with the material being quenched but also independently thereof into the quench bath, for continuous or batchwise separation and removal from the bath. This pretreatment is effected through modification of hydrocarbon-containing pollutants chemically by the oxygen of the added gas while suspended matters of mineral base and oxides (scale) are physically changed through gas absorption of nitrogen and also oxygen. To compound these effects in the boiling aqueous solution of sodium tetraborate, even at significant degree of contamination, it is sufficient to alternately change the partial pressure of oxygen and nitrogen in the gas stream by a maximum of +40%.

The moment and duration of this treatment depends on the result of the quenching intensity control of the bath and the operation as well as on other quenching data of the operation. The amount of air can be determined by the following empirical equation:

$$m_L = \frac{m_{HG}^2}{m_B} \tag{1}$$

wherein $m_l$ is the air mass $m_B$ is the mass of the quenching medium in the bath, $m_{HG}$ is the mass of material being quenched.

The duration of the gas introduction is calculated according to the following equation:

$$t_L = \frac{t_H \cdot m_B}{m_{HG}} \tag{2}$$

wherein $t_L$ is the duration of the gas introduction, and $t_H$ the quenching time of the material being quenched.

The following non-limiting example from an industrial application demonstrates the calculation of the air quantity and the duration of the gas introduction:

Mass of the article being quenched (steel wire coil) =1,000 kg

Quenching period of the article being quenched $t_H$=1 min.

Mass of quenching medium in quench bath =10,000 kg.

In accordance with equation (1), the air quantity being supplied is:

$$m_L = \frac{m_{HG}^2}{m_B} = \frac{1{,}000{,}000\ \text{kg}^2}{10{,}000\ \text{kg}} = 100\ \text{kg}$$

and the duration of injected gas is $$t_L = \frac{t_H \cdot m_B}{m_{HG}} = \frac{1\ \text{min.} \cdot 10{,}000\ \text{kg}}{1{,}000\ \text{kg}} = 10\ \text{min.}$$

The rate of the injection of the air stream can be generally calculated in accordance with the equation $$\dot{m}_L = \frac{m_{HG}^3}{m_B^2 \cdot t_H} \tag{3}$$

so that the rate of the injection is $$\dot{m}_L = \frac{m_L}{t_L} = \frac{100\ \text{kg}}{10\ \text{min.}} = 10\ \text{kg/min}$$

A continuous injection is required when the cycle of the quenching $t_T$ is smaller than the $m_B/M_{HG}$ multiple of the quenching time of the quenched article $t_H$, so that $$t_T < \frac{m_B}{m_{HG}} \cdot t_H \tag{4}$$

Figure 3:
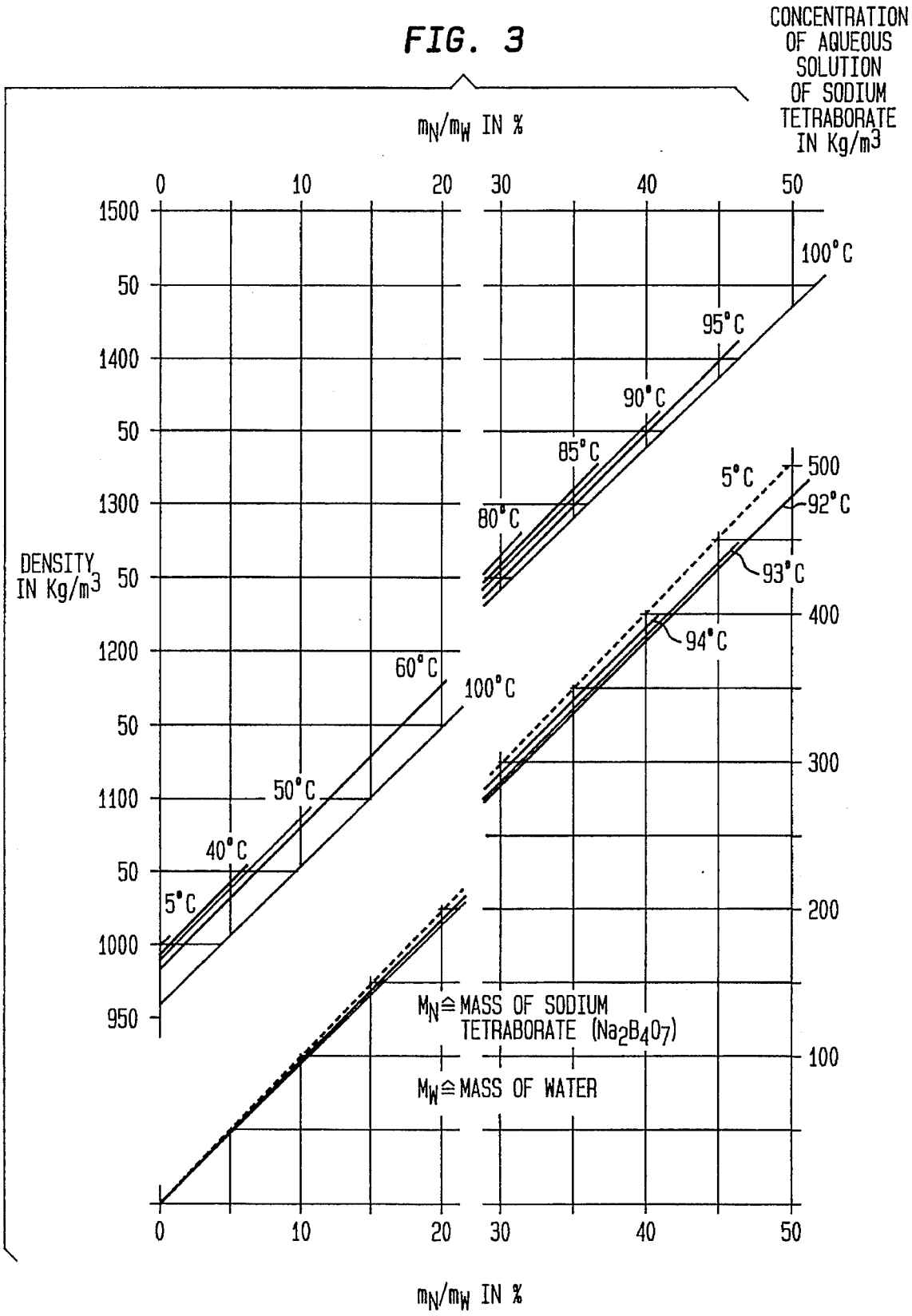
FIG. 3 is a graphical illustration plotting the density of the quenching medium as a function of the percentage of an aqueous solution of sodium tetraborate.
Figure 4:
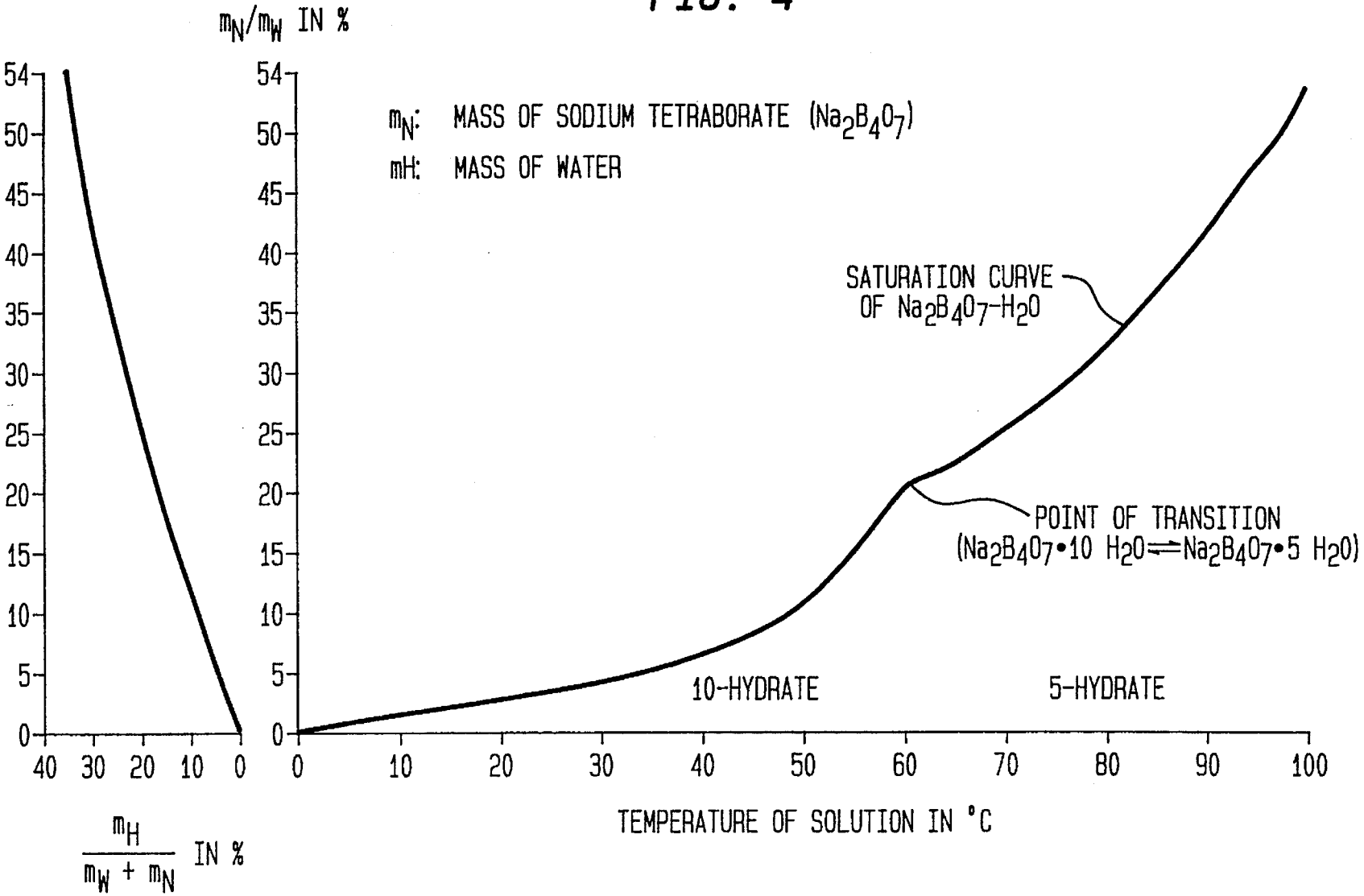
FIG. 4 is a graphical illustration of the saturation curve of the aqueous solution of sodium tetraborate as a function of the temperature.

When adding water vapor to the gas, the separating effect of pollutants from the quenching bath is intensified. During industrial application of the method according to the invention, in particular when openly austentized, quenched and scale precipitates, there are occasions in which the entrained suspended matters of mineral composition - and frequently with adhering organic matters - collect in the bath. Since according to FIG. 3, which is a graphical illustration plotting the density of the quenching medium as a function of the percentage of an aqueous solution of sodium tetraborate, the density of the quenching medium can amount to 1,450 kg per $m^3$ depending on the application, a great fraction of these matters float even though they are heavier than pure water. The addition of water vapor according to the invention results in an acceleration of the separation by moving the organic matters towards the bath surface and the inorganic matters as sediments towards the bath bottom 1*a*. Especially effective is the addition of hot steam at pressures of up to 15 atm (gage) and overheating by about 50K, with steam temperatures of up to 250° C. showing positive effects. I The regeneration of the quench bath and the removal of entrained foreign matters is especially effective when the temperature of the gas mixture or air being injected is lowered by more than 50K compared to the temperature of the quench bath which in boiling conditions is about 101° C. The ensuing undercooling of areas in immediate proximity of the cold gas injection in the bath results in a fine metal crystallization of the dissolved sodium tetraborate from the dissolved state in form of a decahydrate which according to FIG. 4, depicting a graphical illustration of the saturation curve of the aqueous solution of sodium tetraborate as a function of the temperature, is stable below 60° C. Thus, an additional colder and - due to precipitating crystals - lighter layer of sodium tetraborate solution is created for covering the bath surface which is to be penetrated first by introduced gas. This additional layer above the bath surface may also be made without crystallization by admitting a diluted solution or pure water at a temperature below 55° C.

Accordingly, a reduction of the sodium tetraborate content of the quench bath is attained by discharging sodium tetraborate crystals in the cold additional layer from the bath, and later returning it - as required via supply line 3 - to the bath in form of a fresh solution after previously being freed from adhering solids by means of hot water or hot vapor. Thus, metals, especially steel alloys, can be quenched to meet all environmental standards as far as the quenching operation and the maintenance between operational stoppages are concerned. Surprisingly for the user and the expert skilled in the art of quenching is the possibility as afforded by the present invention to provide a quenching medium which can be renewed by adding a gaseous foreign material to the bath in a manner previously described.

While the invention has been illustrated and described as embodied in a method of quenching metals, it is not intended to be limited to the details shown since various modifications and structural changes may be made without departing in any way from the spirit of the present invention. What is claimed as new and desired to be protected by Letters Patent is set forth in the appended claims:

We claim:

1. A method of quenching metals, comprising the steps of quenching said metal in a boiling aqueous solution comprising sodium tetraborate between 20 and 50% by weight and introducing a gas to the solution for compensating losses of components of the solution and preconditioning pollutants in the solution for their subsequent removal.

2. The method of claim 1 wherein the gas is introduced into the solution by means of a lance assembly.

3. The method of claim 1 wherein the gas is blown onto the solution.

4. The method of claim 1 wherein the gas is atmospheric air.

5. The method of claim 1 wherein the gas is introduced in form of nitrogen and oxygen at an atmospheric ratio between nitrogen and oxygen which is alternately increased and decreased.

6. The method of claim 5 wherein the alternating change of the partial pressures between nitrogen and oxygen amounts to a maximum of +/–40%.

7. The method of claim 1 further comprising admixing water vapor to the gas.

8. The method of claim 1 wherein the gas is introduced at a temperature which is lower by more than 45K compared to the temperature of the sodium tetraborate solution of about 101° C.

9. The method of claim 1 wherein the gas is introduced to penetrate a layer of water applied over the sodium tetraborate solution.

10. The method of claim 1 wherein the gas is introduced to penetrate a colder, lighter layer of a sodium tetraborate solution.

* * * * *